US009783997B2

(12) United States Patent
Kim et al.

(10) Patent No.: US 9,783,997 B2
(45) Date of Patent: Oct. 10, 2017

(54) METHOD OF COATING PVC TILE FLOOR WITH IMPROVED FOULING RESISTANCE, ABRASION RESISTANCE, WORKABILITY AND GLOSS

(71) Applicant: ELLIM B.M.S CO., LTD., Seoul (KR)

(72) Inventors: Young Gu Kim, Namyangju-si (KR); Chang Han Jeon, Goyang-si (KR); Sung Won Choi, Namyangju-si (KR)

(73) Assignee: ELLIM B.M.S CO., LTD., Seoul (KR)

( * ) Notice: Subject to any disclaimer, the term of this patent is extended or adjusted under 35 U.S.C. 154(b) by 0 days.

(21) Appl. No.: 15/224,137

(22) Filed: Jul. 29, 2016

(65) Prior Publication Data

US 2017/0030090 A1 Feb. 2, 2017

(30) Foreign Application Priority Data

Jul. 31, 2015 (KR) ..... 10-2015-0108696

(51) Int. Cl.

| | |
|---|---|
| ***E04F 15/10*** | (2006.01) |
| ***B05D 3/00*** | (2006.01) |
| ***B05D 7/02*** | (2006.01) |
| *B05D 3/10* | (2006.01) |
| *B05D 7/00* | (2006.01) |

(52) U.S. Cl.

CPC ..... *E04F 15/10* (2013.01); *B05D 3/007* (2013.01); *B05D 7/02* (2013.01); *B05D 3/101* (2013.01); *B05D 7/534* (2013.01)

(58) Field of Classification Search

None

See application file for complete search history.

(56) References Cited

U.S. PATENT DOCUMENTS 5,703,109 A 12/1997 Karjalainen et al.

FOREIGN PATENT DOCUMENTS

| | | | |
|---|---|---|---|
| JP | 2002-172078 | A | 6/2002 |
| JP | 2003-504095 | A | 2/2003 |
| KR | 10-1993-013027 | A | 7/1993 |
| KR | 98-075109 | A | 11/1998 |
| KR | 10-0167000 | B1 | 2/1999 |
| KR | 10-0184731 | B1 | 5/1999 |
| KR | 10-2014-0076340 | A | 6/2014 |

*Primary Examiner* — Nathan T Leong

(74) *Attorney, Agent, or Firm* — Novick, Kim & Lee, PLLC; Jae Youn Kim

(57) ABSTRACT

Provided is a method of coating a PVC tile floor with improved fouling resistance, abrasion resistance, workability and gloss. The method includes forming wax coating having a plurality of layers (a multilayer structure) on the surface of PVC tiles, and coating the uppermost surface of a wax layer with a coating agent for polishing stone surfaces so that a protective coating film for primarily protecting the floor from the outside is formed unlike a conventional floor coating having a pure wax layer structure, thereby advantageously fundamentally preventing scratches and stains of the surface, avoiding detachment and sliding of films and greatly improving durability and safety in use, and, in spite of simplified coating process, preventing yellowing, securing superior gloss, and improving workability and processability as well as maintenance/conservation after working and economic efficiency.

1 Claim, 4 Drawing Sheets

| | |
|---|---|
| Foundation (S100) | Tile lisking -> Cleaning -> Rinsing -> Wax application -> drying (repeated, if necessary) |
| Glazing (S200) | Cleaning wax surface -> rinsing -> spraying coating agent -> glazing/coating -> removing dust |
| Second glazing (S300) | Wax coating -> spraying coating agent -> glazing/coating -> removing dust |
| Third Glazing (S400) | Wax coating -> removing dust -> spraying coating agent -> glazing/coating -> removing dust |
| Fifth glazing (S400) | Wax coating -> removing dust -> spraying coating agent -> glazing/coating -> removing dust |

| | |
|---|---|
| Foundation (S100) | Tile lisking -> Cleaning -> Rinsing -> Wax application -> drying (repeated, if necessary) |
| Glazing (S200) | Cleaning wax surface -> rinsing -> spraying coating agent -> glazing/coating -> removing dust |
| Second glazing (S300) | Wax coating -> spraying coating agent -> glazing/coating -> removing dust |
| Third Glazing (S400) | Wax coating -> removing dust -> spraying coating agent -> glazing/coating -> removing dust |
| Fifth glazing (S400) | Wax coating -> removing dust -> spraying coating agent -> glazing/coating -> removing dust |

FIG. 1

- First step

| Order | Work details | Image | Equipment | Chemicals /materials | Items |
|---|---|---|---|---|---|
| 1 | Spraying coating agent | 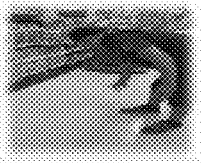 | | Coating agent | |
| 2 | Coating (at the same \ time, glazing) | 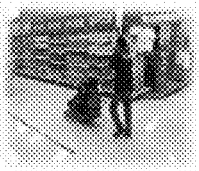 | Glazer | Pad for glazer | |
| 3 | Removing dust | 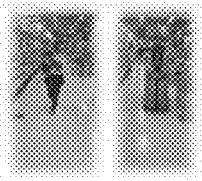 | Cleaning car | Lisking mop | |

FIG. 2

— Second step

| Order | Work details | Image | Equipment | Chemicals / materials | Items |
|---|---|---|---|---|---|
| 1 | Glazing (wax coating layer) | | Glazer | Pad for glazer | |
| 2 | Removing dust | | Cleaning car | Lisking mop | |
| 3 | Spraying coating agent | | | Coating agent | |
| 4 | Coating | | Polishing machine | Pad | |
| 5 | Glazing (on coating surface layer) | | Glazer | Pad for glazer | |
| 6 | Removing dust | | Cleaning car | Lisking mop | |

FIG. 3

– Third step

| Order | Work details | Image | Equipment | Chemicals /materials | Items |
|---|---|---|---|---|---|
| 1 | Spraying coating agent | | | Coating agent | |
| 2 | Coating | | Polishing machine | Pad | |
| 3 | Glazing (on coating surface layer) | | Glazer | Pad for glazer | |
| 4 | Removing dust | | Cleaning car | Lisking mop | |

FIG. 4

※ Coating agent contains wax and is thus free from problems such as chemical reactions.

METHOD OF COATING PVC TILE FLOOR WITH IMPROVED FOULING RESISTANCE, ABRASION RESISTANCE, WORKABILITY AND GLOSS

BACKGROUND OF THE INVENTION

Field of the Invention

The present invention relates to a method of coating a PVC tile floor with improved fouling resistance, abrasion resistance, workability and gloss. More specifically, the present invention relates to a method of coating a PVC tile floor with improved fouling resistance, abrasion resistance, workability and gloss including forming floor coating having a plurality of layers (a multilayer structure) on the surface of PVC tiles, and applying a coating agent for polishing stone surfaces to an upper surface of a wax layer and glazing the surface so that a protective coating film for primarily protecting the floor from the outside is formed unlike a conventional method of coating floors having a pure wax layer structure, thereby advantageously fundamentally preventing scratches and stains of the surface, avoiding detachment and sliding of films and greatly improving durability and safety in use, and, in spite of simplified coating process, preventing yellowing, securing superior gloss, and improving workability and processability as well as maintenance/conservation after working and economic efficiency.

In addition, the present invention fundamentally excludes conventional frequently repeated detachment operations (using a toxic chemical detergent for 3 to 6 months), thereby advantageously reducing a cost increase due to use of conventional detergents, preventing environmental pollution, providing an eco-friendly floor coating, and solving the problems including sliding of workers which occur during conventional detachment and generation of respiratory diseases from harmful chemical substances.

Description of the Related Art

In general, polyvinylchloride (PVC) resins (commonly, referred to as "P tiles") are widely used as various house and industrial floor materials because they are lightweight and have superior workability and transparency, as compared to other materials.

Meanwhile, the surfaces of P tiles generally have serious drawbacks of low abrasion resistance, chemical resistance, heat resistance and weatherability, and are particularly unsuitable for use alone because a plasticizer is readily released from the surfaces and contaminants are readily adsorbed on the surfaces. In this regard, P tile floor materials are surface-cured by UV light at room temperature using a photocuring coating agent containing a urethane acrylate having an aliphatic cyclic structure as a main ingredient so that surface physical properties such as abrasion resistance, chemical resistance and weatherability can be improved. This method is disclosed in Korean Patent Laid-open Publication Nos. 93-013027 and 98-075109.

In addition, Korean Patent No. 184731 and U.S. Pat. No. 5,703,109 disclose further addition of an antistatic agent as other additive to improve fouling resistance of floor materials.

However, such a conventional coating method for surface protection has problems in that films are seriously damaged upon exposure of momentary heat such as cigarette light to PVC floor materials and outer surfaces thereof are burned black, contaminant substances are not readily removed, and outer appearance and durability are thus seriously deteriorated.

This is because, in spite of repeated contraction and expansion with temperature, photocuring coating compositions are blended for better flexibility in order to maintain adhesion to the PVC layers and, for this reason, films are readily deteriorated upon exposure to momentary heat such as cigarette light due to relatively low cross-linking density and the heat can be transferred to the PVC layer and accumulated therein.

However, when cross-linking density is increased in order to improve heat resistance of coating films, disadvantageously, the coating films are seriously contracted, adhesion strength is lowered, cracks occur and PVC floor materials are seriously deformed with temperature.

In other words, the conventional P tile coating method has many problems of low durability due to readily generation of detachment within a short time and of increased maintenance/management costs resulting from the necessity of repeated recoating due to weakness to stains or abrasion and poor gloss.

SUMMARY OF THE INVENTION

Therefore, the present invention has been made in view of the problems resulting from limitations and drawbacks of the related art and provides a method of coating a PVC tile floor with improved fouling resistance, abrasion resistance, workability and gloss including forming floor coating having a plurality of layers (a multilayer structure) on the surface of PVC tiles, and applying a coating agent for polishing stone surfaces to an upper surface of a wax layer and glazing the surface so that a protective coating film for primarily protecting the floor from the outside is formed unlike conventional coating floors having a pure wax layer structure, thereby advantageously fundamentally preventing scratches and stains of the surface, avoiding detachment and sliding of films and greatly improving durability and safety in use, and, in spite of simplified coating process, preventing yellowing, securing superior gloss, and improving workability and processability as well as maintenance/conservation after working and economic efficiency.

In accordance with one aspect of the present invention, the above and other objects can be accomplished by the provision of a method of coating a PVC tile floor with improved fouling resistance, abrasion resistance, workability and gloss, the method including a foundation step (S100) including mopping a PVC tile floor in a predetermined working area with an oil cloth, cleaning the floor with a chemical, washing the same by rinsing and naturally or artificially drying the same and a glazing step (S200) including applying a wax to the PVC tile floor having undergone the foundation step, drying the same for a predetermined time, applying a coating agent thereto with a gas glazer, glazing the applied coating agent with a gas glazer, removing dust, and conducting lisking and cleaning.

The glazing step (S200) is carried out such that the coating agent is sprayed in an amount of 3 ml per a tile (45 cm*45 cm).

In addition, the glazing step (S200) is carried out using a gas glazer having a weight of 100 to 150 kg and a horsepower of 20 PS.

In the glazing step (S200), preferably, the pad used for application and glazing of the coating agent is a cotton pad or a white pad, the number of rotations of the pad of the gas glazer upon application of the coating agent is 1,200 to 1,300 rpm, and the number of rotations of the pad of the gas glazer upon glazing of the coating agent is 1,600 to 1,700 rpm.

Furthermore, in the glazing step (S200), the gas glazer is provided with a heat supply so that a heat source of 30 to 60° C. is supplied during application and glazing with the pad to improve quality of application and glazing and reduce working time.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a flowchart illustrating a coating method according to an embodiment of the present invention;

FIGS. 2 to 4 are schematic flowcharts illustrating a glazing step, and second to fourth glazing steps according to the present invention.

DETAILED DESCRIPTION OF THE INVENTION

Figure 5:
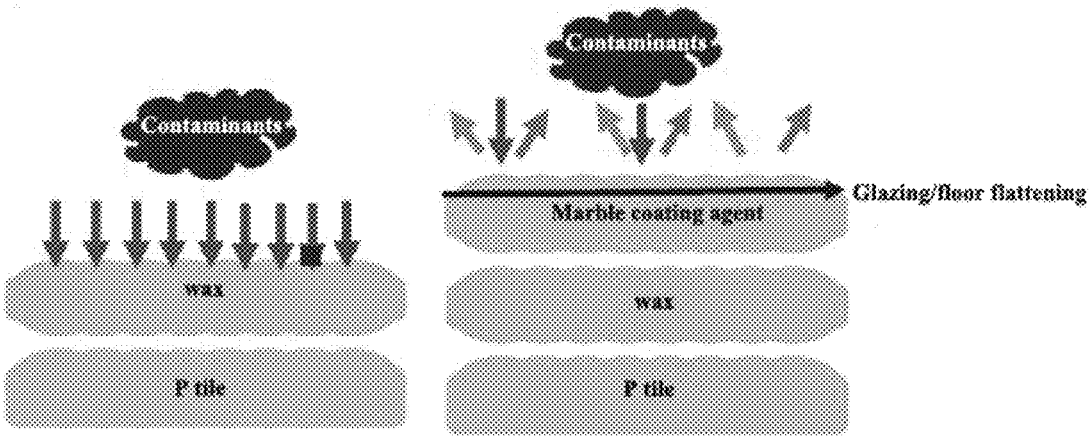
FIG. 5 is a sectional view illustrating a floor layer treated by the coating method according to the present invention and a sectional view illustrating a conventional floor layer compared therewith.

Hereinafter, embodiments according to the present invention will be described in detail with reference to the annexed drawings.

First, as shown in FIGS. 1 to 4, the present invention broadly includes a foundation step (S100) and a glazing step (S200).

In this regard, the foundation step (S100) includes mopping a PVC tile floor in a predetermined working area with an oil cloth, cleaning the floor with a chemical, washing the same with a rinse and naturally or artificially drying the same.

That is, the foundation step is carried out at an interval of 4 to 6 months for 15 to 30 times in the order of lisking (mopping with an oil cloth)→chemical cleaning→rinsing (cleaning)→wax application→drying.

In such a foundation step, the cleaned part may be semi-detached, depending on the degree of contamination.

Accordingly, the present invention relates to applying or coating a coating layer in the form of a protective film or a safety film including a plurality of layers based on the aforementioned foundation step and the present invention results in great improvement in resistance to contaminant sources (cleanliness).

That is, the glazing step (S200) of the present invention includes applying a wax to the PVC tile floor subjected to the foundation step, drying the same for a predetermined time, applying a coating agent thereto with a gas glazer, drying the same for a predetermined time, applying a coating agent thereto with a gas glazer, glazing the applied coating agent using a gas glazer and then removing dust, and conducting lisking and cleaning.

In this case, the coating agent can be suitably selected and may for example be either a marble coating agent or a chemical coating agent, as necessary.

In this case, the drying is preferably air drying for 24 hours or drying using a heater for 8 to 10 hours.

This is because, when drying time is too short, a wax layer becomes soft and a film formed by application a coating agent thereto is not hard and breaks, and when the drying time is too long, adhesion strength is deteriorated upon application of the coating agent, and surface coatability is deteriorated upon the following glazing.

In addition, the gas glazer has the capacity to conduct rapid operation owing to a high rate of rotation as compared to the large area, while securing a suitable weight (pressure), as compared to conventional carrier-type equipment, polishing machines, cleaning cars, wax machines and electric glazers. This is because adhesion of the coating agent is excellent based on a high revolution-type pad, while applying a suitable pressure to the floor surface to which the coating agent is applied.

Meanwhile, the glazing step (S200) aims to apply a coating agent and glazing, without causing scratches or defects to the wax layer having undergone the foundation step. The glazing step (S200) is carried out such that the coating agent is sprayed in an amount of 3 ml per tile (45 cm*45 cm).

In this case, the spray speed is 500 m/s and is preferably adjusted such that a thin film with a thickness of about 1 mm is formed on the PVC tile floor.

In addition, the glazing step (S200) is carried out using a gas glazer having a weight of 100 to 150 kg and a horsepower of 20 PS.

In this case, in the glazing step (S200), a cotton pad mixed with a synthetic fiber or a white pad is preferably used during application of the coating agent and glazing.

This is because using an ordinary black pad, red pad, blue pad, or steel pad may make the surface rough and the wax layer may be disadvantageously worn or damaged (removed) upon use. On the other hand, this is because, a pure cotton pad absorbs a great amount of the coating agent and thus has a drawback of low working speed.

In addition, according to the present invention, when a white pad is used, preferably, the number of rotations of the pad of the gas glazer upon application of the coating agent is 1,200 to 1,300 rpm, and the number of rotations of the pad of the gas glazer upon glazing of the coating agent is preferably 1,600 to 1,700 rpm.

Furthermore, in the glazing step (S200), the gas glazer is provided with a heat supply so that a heat source of 30 to 60° C. is supplied during application and glazing with the pad to improve quality of application and glazing and reduce working time.

In this case, the white pad is made of a combination of cotton and a synthetic resin, fiber strands thereof are coated with an oil in order to conduct application and glazing based on pressurization while preventing scratches or damage caused by friction with the wax layer.

Meanwhile, after glazing, additional glazing (second glazing) may be conducted. The second glazing step (S300) is carried out by coating with a wax, applying (spraying) a coating agent, glazing the surface with a gas glazer, and removing dust (lisking and cleaning).

In this case, in accordance with the second glazing step (S300), the pad used for application and glazing of the coating agent is a synthetic fiber pad containing cotton or a white pad, and preferably, the number of rotations of the pad of the gas glazer upon coating of the coating agent is 1,400 to 1,500 rpm, and the number of rotations of the pad of the gas glazer during glazing of the coating agent is 1,800 to 1,900 rpm.

Furthermore, in the second glazing step (S300), the gas glazer is provided with a heat supply so that a heat source of 65 to 70° C. is supplied during application and glazing with the pad to improve quality of application and glazing and reduce working time.

In this case, the gas glazer can be used in the previous glazing step including the second glazing step (S300) as well and it is advantageous in that application and glazing steps can be simultaneously conducted with one equipment. Accordingly, the gas glazer results in reduced work speed and significant labor costs savings, has an advantage of possibly omitting a detachment step, as compared to the prior art, prevents safety accidents of workers and greatly reduces labor costs.

In this case, the application is primarily rubbing after spraying a coating agent to the wax-coated PVC tile floor and is roughly putting over the entire surface as if the surface of shoes turns white when a shoe polish is applied to the surface of shoes.

In addition, the glazing is carried out by weight contact high-rotation so that the applied (whitened) coating agent can provide gloss.

Meanwhile, after the second glazing, additional third glazing (S400) may be conducted. The third glazing step (S400) is carried out by coating with a wax, conducting surface-treatment with a glazer, hardening the wax layer, removing dust (lisking and cleaning), applying (spraying) a coating agent thereto, glazing the surface with a marble polishing machine, and removing dust (lisking and cleaning).

In this case, regarding the third glazing step (S400), preferably, the pad used for application and glazing of the coating agent is a fiber pad or white pad, the number of rotations of the pad of the gas glazer upon application of the coating agent is 1,500 to 1,600 rpm, and the number of rotations of the pad of the gas glazer upon glazing of the coating agent is 2,000 to 2,200 rpm.

Furthermore, in the third glazing step (S400), the gas glazer is provided with a heat supply so that a heat source of 70 to 80° C. is supplied during application and glazing with the pad to improve quality of application and glazing and reduce working time.

That is, the gas glazer is a kind of marble polishing machine. In the case of coating a surface, an expensive coating agent for protecting marble is used so that durability and gloss can be significantly improved. In particular, resistance to contaminant sources such as fried Kimchi, cola, and ice cream in the market, and protection from the risk of a safety accident such as sliding can be improved due to significantly reduced slipperiness.

Accordingly, the coating agent is prepared by mixing with a wax.

Meanwhile, after third glazing, additional fourth glazing (S500) may be conducted. The fourth glazing step (S500) is carried out by coating with a wax, conducting surface-treatment with a glazer, hardening the wax layer, removing dust (lisking and cleaning), applying (spraying) a coating agent, glazing the surface with a marble polishing machine and removing dust (lisking and cleaning).

In this case, regarding the fourth glazing step (S500), the pad used for application and glazing of the coating agent is a fiber pad or a white pad, the number of rotations of the pad of the gas glazer upon application of the coating agent is 1,700 to 1,800 rpm, and the number of rotations of the pad of the gas glazer upon glazing of the coating agent is 2,300 to 2,500 rpm.

Furthermore, in the fourth glazing step (S500), the gas glazer is provided with a heat supply so that a heat source of 70 to 80° C. is supplied during application and glazing with the pad to improve quality of application and glazing and reduce working time.

In this case, in the second to fourth glazing after the glazing, applying a coating agent to a wax surface layer may be conducted during working, and cleaning, rinsing and removing dust may be conducted before glazing.

As a result, the glazing after the foundation step can be used for coating an area of about 100 pyeong per hour, and the second to fourth glazing steps can be conducted to maximize coatability in narrow areas such as offices, not large areas.

As such, according to the present invention, floor coating having a plurality of layers (a multilayer structure) can be conducted on the surface of PVC tiles, and a coating agent for polishing stone surfaces is applied to and subjected to glazing on an upper surface of the wax layer so that a protective coating film for primarily protecting the floor from the outside is formed as compared to conventional floor coatings having a pure wax layer structure. This advantageously fundamentally prevents scratches and stains of the surface, avoids detachment and sliding of films and greatly improves durability and safety in use.

In addition, while providing a simple working process, the present invention advantageously prevents yellowing, secures superior gloss, and improves workability and processability as well as maintenance/conservation after working and economic efficiency.

In other words, the present invention significantly improves coatability on PVC tiles, provides low cost and high quality, reduces the amount of detergents used for removing various contaminant sources, prevents damage to tiles by detachment, and relieves worker fatigue based on simplified coating process.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of coating a PVC tile floor with improved fouling resistance, abrasion resistance, workability and gloss, the method comprising:

a foundation step comprising mopping the PVC tile floor in a predetermined working area with an oil cloth, cleaning the floor with a chemical, washing the floor using a rinse, and naturally or artificially drying the floor; and a glazing step comprising applying a wax to the PVC tile floor having undergone the foundation step, drying the PVC tile floor for a predetermined time, applying a coating agent thereto with a gas glazer, removing dust, and conducting lisking and cleaning, wherein the drying after the wax application is carried out by air drying for 24 hours or drying using a heater for 8 to 10 hours in order to prevent problems in which a wax layer becomes soft, and a film formed by the application of the coating agent thereto is not hard or breaks, or adhesion strength is deteriorated upon the application of the coating agent thereto and surface coatability is deteriorated upon the following glazing, the coating agent coated after the wax application is a marble coating agent, and a cotton pad mixed with a synthetic fiber is used for the application and glazing of the marble coating agent, wherein fiber strands of the mixed cotton pad are coated with an oil in order to conduct application and glazing based on pressurization while preventing scratches or damage caused by friction with the wax layer, and the gas glazer is installed so that a heat source is supplied during the wax application and glazing of the marble coating agent with the pad to improve quality of application and glazing, and reduce working time and provides rapid coating based on a predetermined weight and a given revolution per minute (rpm) so that a predetermined pressure is applied to the surface of the marble coating agent-applied wax and the marble coating agent is efficiently adhered by a high rotation-type pad.

* * * * *